US005778489A

United States Patent [19]

Marshal, II

[11] Patent Number: 5,778,489

[45] Date of Patent: Jul. 14, 1998

[54] DETACHABLE HANDLE FOR A RECEPTACLE

[76] Inventor: Henry W. Marshal, II. 1076 Kaolin Rd., Kenneth Square, Pa. 19348

[21] Appl. No.: 798,856

[22] Filed: Feb. 12, 1997

[51] Int. Cl.[6] ..... A47B 95/02

[52] U.S. Cl. ..... 16/114 R; 220/755; 294/27.1

[58] Field of Search ..... 16/114 R, 112, 16/125, 126, 127; 220/755, 759, 760, 761, 762; 294/27.1, 29, 31.1

[56] References Cited

U.S. PATENT DOCUMENTS

| | | | |
|---|---|---|---|
| 2,001,947 | 5/1935 | Upham | 220/755 |
| 2,048,022 | 7/1936 | Orr | 220/94 |
| 2,188,728 | 1/1940 | Spencer | 220/96 |
| 2,353,555 | 7/1944 | Gore | 220/90 |
| 2,540,860 | 2/1951 | Blomquist | 294/27 |
| 2,681,785 | 6/1954 | Jenny | 248/210 |
| 2,788,153 | 4/1957 | Broadbelt | 220/90 |
| 2,839,323 | 6/1958 | Jamieson | 294/31.2 |
| 2,849,252 | 8/1958 | McLean | 294/31.2 |
| 3,661,351 | 5/1972 | Olsen . | |
| 4,045,069 | 8/1977 | Fife | 294/31.2 |
| 4,053,131 | 10/1977 | Francis | 248/211 |
| 4,266,746 | 5/1981 | Klaiber | 248/113 |
| 4,491,293 | 1/1985 | Tibbs | 248/211 |
| 4,823,433 | 4/1989 | Curtis | 16/114 R |
| 4,832,293 | 5/1989 | Gizzi | 248/110 |
| 4,895,269 | 1/1990 | Cade | 220/759 |
| 4,919,298 | 4/1990 | Gregory | 220/759 |
| 4,993,767 | 2/1991 | Song . | |
| 5,445,425 | 8/1995 | Lyver | 294/31.2 |

FOREIGN PATENT DOCUMENTS

| | | | |
|---|---|---|---|
| 2229987 | 10/1990 | United Kingdom | 220/755 |

*Primary Examiner*—Chuck Mah
*Attorney, Agent, or Firm*—Ratner & Prestia

[57] ABSTRACT

The invention is a detachable handle for a receptacle wherein the handle comprises a base plate having a front edge, a back side opposite the front edge, a top surface, a bottom surface and a handle bar mounted on the top surface of the base plate. The handle bar includes a grip which has a pressure applying front section, a back section and a bottom section. The handle further includes a rim engaging tab extending from the bottom surface of the base plate adjacent the back side and adapted to engage the rim of the receptacle between the tab and the bottom side of the base plate.

10 Claims, 3 Drawing Sheets

DETACHABLE HANDLE FOR A RECEPTACLE

BACKGROUND OF THE INVENTION

1. Field of the invention

This invention relates to a handle accessory for a receptacle. More particularly, the invention relates to an offset handle accessory and paint brush holder for a paint can which cooperates with the bail of the paint can to hold the can upright when painting.

2. Description of Related Art

Nearly every paint can sold to the general public today comprises a cylindrical paint bucket having a swingably attached wire-thin handle which extends over the open top of the paint can. In some cases, the paint can manufacturer will add a gripping element to the wire-thin handle to make holding the can from the bail somewhat less painful.

Due to the swinging attachment of the bail, it is quite difficult to hold the paint can in a stable fashion. This is a serious problem for painters who paint using paint directly from the can. For example, as one is standing on a ladder and painting with one hand while holding the paint can on the other, one often finds that the paint can swings to and fro uncontrollably resulting in possible unwanted paint dripping.

The attachment of the handle is also such that the paint can hangs straight down with the bail and the painter's hand covering the center portion of the can opening, making it quite difficult to both hold the can and dip the paintbrush into the paint without smearing paint on the paint can holding hand. This is bothersome to the user and the extra care which must be expended to avoid smearing becomes tedious and time consuming.

Finally, and again particularly pertaining to those who paint directly from the can, in order to wipe excess paint from the brush, one tends to wipe the brush along the rim of the paint can. This however results in paint accumulating along the rim which then smears the painter and the can top when one attempts to close the can by pressing the lid back onto the rim. Further more it is difficult to brush off paint from the brush evenly and satisfactorily against a concave surface.

To resolve such problems a number of accessories have been developed. U.S. Pat. No. 4,823,433 issued Apr. 25, 1989 to George C. Curtis discloses a detachable handle which attaches to the bail and rim of the can and holds the bail at an angle of about 45 degrees from vertical. The handle which includes a channel into which fits the bail, has a hook which extends from the handle towards the can rim and which hooks on the underside of the rim.

This arrangement suffers in that the painter's hand on the bail is unprotected from the contents of the can and can easily be smeared with any splashing paint. Further more when the paint can is placed on any supporting surface the handle tends to fall into the can. Finally and most importantly, a lot of twisting pressure must be applied to the handle to maintain the can in a vertical position since the point from which the can is suspended is no longer directly above the can centerline.

As such, there is still a need for a paint can holder which can be attached to a paint can and permits holding the can comfortably in a substantially vertical position with one hand, while painting with the other, and which allows the painter to place the can on a supporting surface without removing the handle, as well as to provide him with a place to rest the brush when not actually painting.

These and other objects of the present invention will become clear from the following description.

SUMMARY OF THE INVENTION

The invention relates to a detachable handle for a receptacle having an interior, an open top having an area, a lateral wall, a rim extending inwardly from the lateral wall, and a bail swingably mounted on diametrically opposed points on said wall, the handle comprising:

a base plate having a front edge, a back side opposite said front edge, a top surface, and a bottom surface;

a rim engaging tab extending from the bottom surface of the base plate adjacent the back side adapted to engage the rim between said tab and said bottom side; and a handle bar mounted on said base plate, the handle bar comprising a grip having a pressure applying front section, a back section and a bottom section, wherein:

I) the front pressure applying section terminates at a top edge and extends at an angle between 0° and 90° measured clockwise from a reference plane perpendicular to the base;

ii) the bottom section has an outer convex curved surface extending to a point which is more than one inch away from the top surface of the base; and iii) at least one bail engaging slot for receiving and maintaining the bail at an angle of between 20° and 60°0 from said reference plane when said base is mounted on said can, the bail engaging slot having a bottom being at a distance measured from the base top surface which is less than a distance measured from the base top surface to the top edge of the front pressure applying section.

Preferably there is also provided in the handle front pressure section a notch for receiving a handle portion of a paint brush, and for holding said brush at an angle with said perpendicular plane when the tip of the brush is place against the front end of the base.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
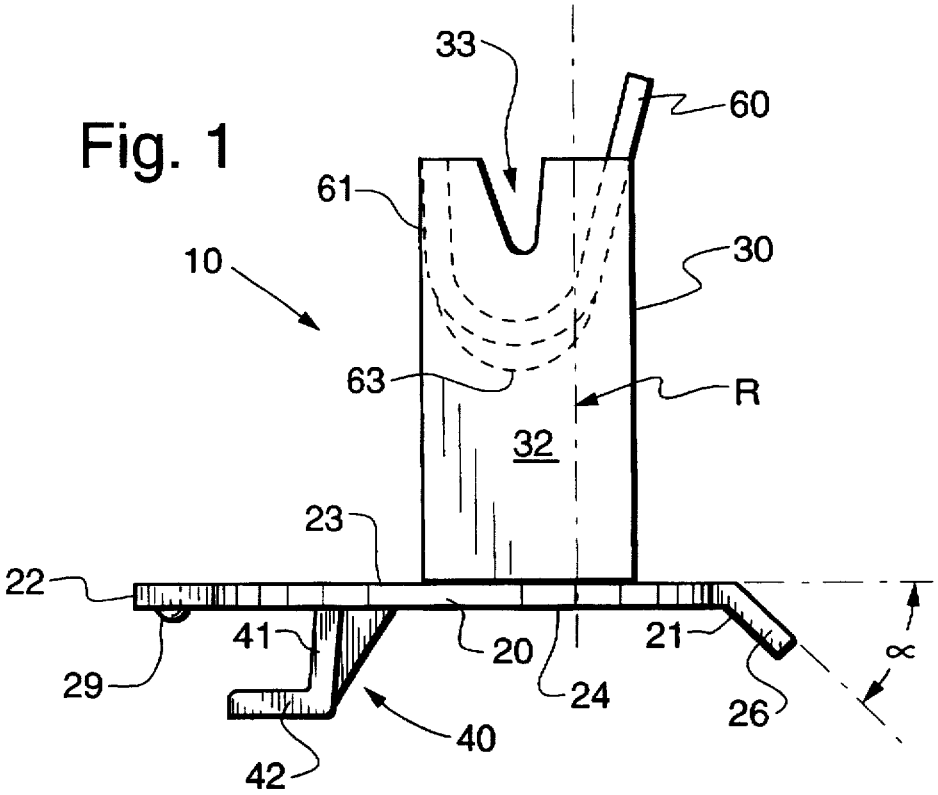
FIG. 1 is a schematic elevation representation of a paint can holder in accordance with the present invention.

Throughout the following detailed description, similar reference characters refer to similar elements in all figures of the drawings.

Figure 2:
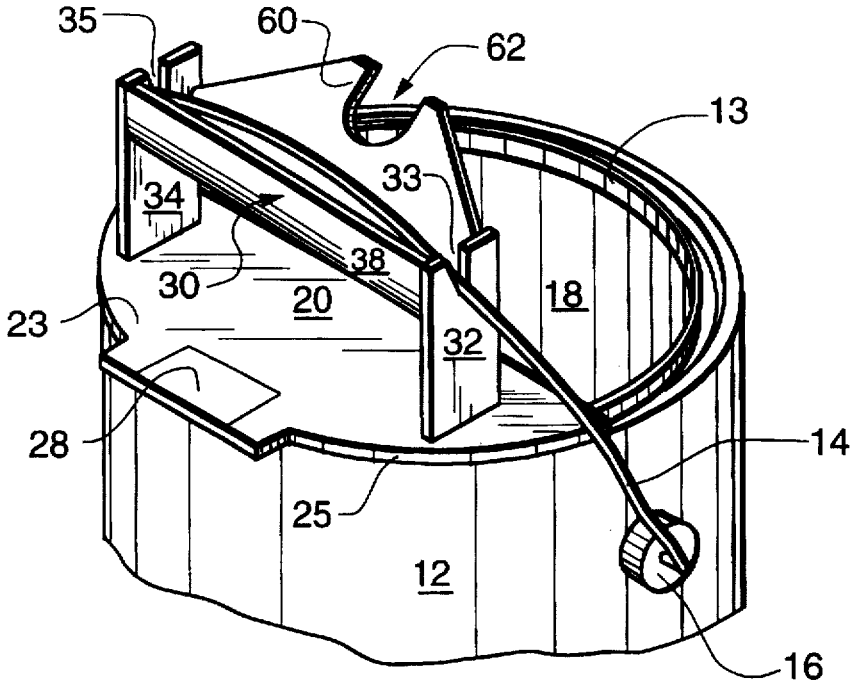
FIG. 2 is a perspective illustration of a holder in accordance with the present invention shown mounted on a paint can.
Figure 3:
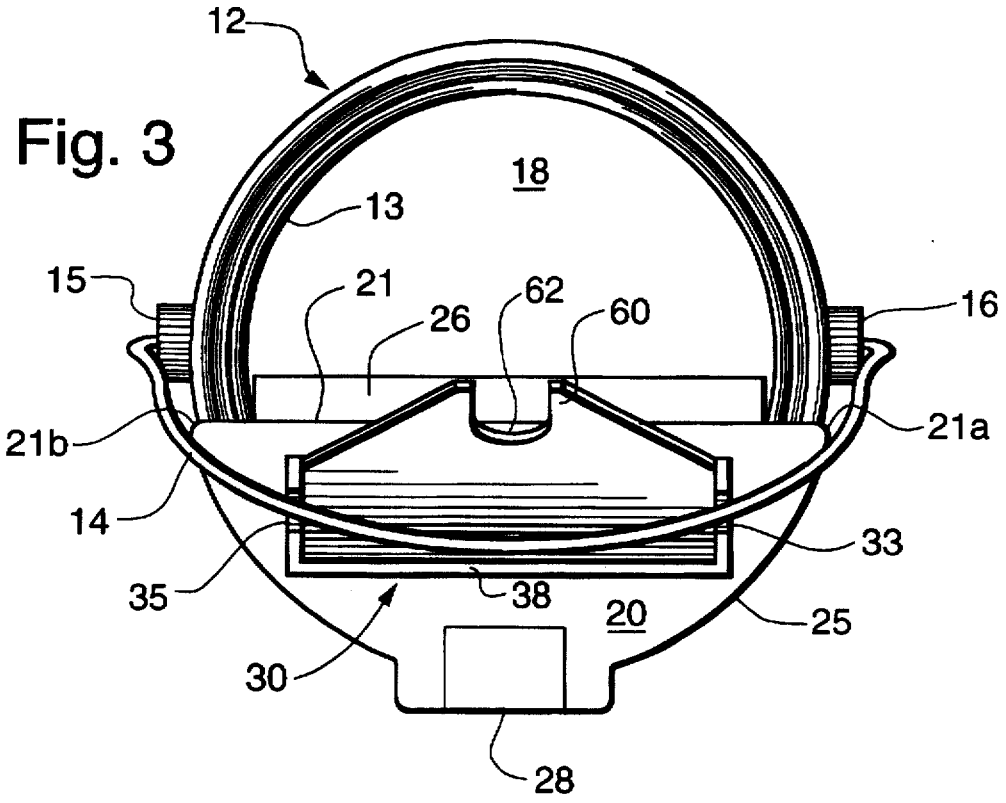
FIG. 3 is a top view of the holder and paint can depicted in FIG. 2.

Referring now to FIGS. 1 through 3, there is shown a handle 10 for use on a paint can or similar container 12 constructed according to this invention. The handle 10 generally comprises a base plate 20 and a handle bar 30.

The base plate 20 has a front edge 21, a back side generally indicated by the numeral 22, a top surface 23, a bottom surface 24 and an outer perimeter 25. The base plate 20 comprises a flat plate which is adapted to fit over and cover a portion of the open top of the receptacle with which it is being used. The base plate 20, once attached to the receptacle 12, is adapted to sit in the same plane as that of the open top of the receptacle 12. Preferably, the base plate 20 is sized to cover less than half of the area of the open top. The base plate 20 must be sufficiently thick to provide sufficient strength to prevent buckling or deforming under the weight of a full container supported by the handle. Such thickness will be a function of the materials used to construct it. In practical terms base plate 20 will have a thickness in the range of 1/16 to 1/4 inches.

The outer perimeter 25 and front edge 21 define the area of base plate 20. Front edge 21 of base plate 20 preferably comprises a straight edge having a left end 21*a* and a right end 21*b*. Outer perimeter 25 extends from the right end 21*a* to the left end 21*b* preferably, but not necessarily, in a similar shape as the shape of the outer perimeter of receptacle 12. Since the most common anticipated use of this invention is with one gallon paint cans, the base 20 will be a circular segment large enough to fit and rest over the one gallon can top covering less than half of the open top area.

Front edge 21 may serve as a paint brush wiping edge, or, preferably may include a separate paint brush supporting and wiping ledge 26. Supporting and wiping ledge 26 extends along a substantial portion of front edge 21, is rectangular in shape, and extends from front edge 21 at an angle toward the interior of the receptacle. Ledge 26 is sized to fit inside the available width of the receptacle opening and its length is preferably limited so that more than half of the receptacle top opening remains uncovered.

Ledge 26 extends into the interior 18 of receptacle 12 from plate 20 at an angle $\mu$ from the plane of plate 20. Generally, angle $\mu$ can be any desired angle so long as the bristles of a paint brush can be wiped thereon. Thus, angle $\mu$ can range anywhere from 0° to 90° from the plane of base plate 20 toward the interior 18 of the receptacle 12, but is preferably 45°.

Receptacles which are contemplated to be used with the handle of the present invention include a rim 13 which extends inwardly from the outer perimeter of the receptacle along the plane of the open top. The handle of the present invention includes, adjacent its back end 22, a rim engaging tab 40 extending from the bottom surface 24 of the base plate 20, best seen in FIG. 1. Rim engaging tab 40 is preferably an L-shaped tab, comprising a vertical stem 41 and a horizontal engager 42. The opening of the "L" is pointing towards the back end of the base and is sized to accept, preferably snugly, the rim 13 of the receptacle. This is possible since most such receptacles as contemplated herein are constructed from similar size materials having rims of about the same thickness. A distance of about 0.4 inches between the bottom of the base and the engager will provide the needed spacing to accept most rims encountered in practice. A retaining knob 29 may be included on the bottom side of the base plate which co-operates with the rim engaging tab to further secure the base on the receptacle rim.

In a preferred embodiment, the back 22 of the perimeter 25 of base plate 20 forms a rectangular extension 28 which extends beyond the receptacle top when the handle is mounted thereon. The knob 29 is on the bottom side of the extension 28 which may be made flexible enough so that it deflects as the handle base is pushed in place clamping the base of the handle onto the rim between the knob and the engaging tab.

The handle also includes a handle bar 30 on the top surface 23 of plate 20. Handle bar 30 comprises a first support 32, a second support 34 and a grip 38 extending between the first and second supports. The handle bar 30 has two purposes. The first is to hold the bail 14 of the receptacle 12 in an offset position over the open top of the receptacle 12. The second purpose is to provide a comfortable grip for the user to hold the receptacle in a substantially vertical position with less force than what is required by the devices of the prior art.

Each of first and second supports 32 and 34 extend from the top surface 23 of plate 20 in a direction perpendicular to the plane of top surface 23. Supports 32, 34 must be solid enough to hold up to the stresses placed thereon by the weight of the receptacle 12 through bail 14. The height of each support 32, 34 is not, per se, critical to the invention, although the height must be enough to allow for an attachment of the grip 38 whereby the distance between the grip 38 and the top surface 23 of the base plate 20 is enough to fit a user's fingers and to allow the bail to be held in the handlebar 30 as will be discussed below.

Each support 32 and 34 includes a bail engaging slot 33 and 35 respectively. Bail engaging slots 33, 35 are generally V-shaped slots cut into the top portion of the supports 32, 24 and adapted to hold the bail 14 of the receptacle 12. Because base plate 20 is adapted to cover less than the area of the open top of the receptacle, it naturally follows that the bail 14 will be in an offset position over the open top when contained within the bail supporting slots 33, 35. It is preferred that the bail 14 fit snugly within slots 33, 35. As such, the bottom of bail supporting slots 33, 35 must be at a distance from the top surface 23 of plate 20 such that the bail when inserted in the slots with the base resting on the top of the receptacle will form an angle $\beta$ with a reference plane "R" perpendicular to the base which is between 20° and 60° and preferably between 22° and 26°. The width of the slots 33 and 35 is selected such that at the narrowest point they will accommodate such a snug fit of the bail 14.

Figure 4:
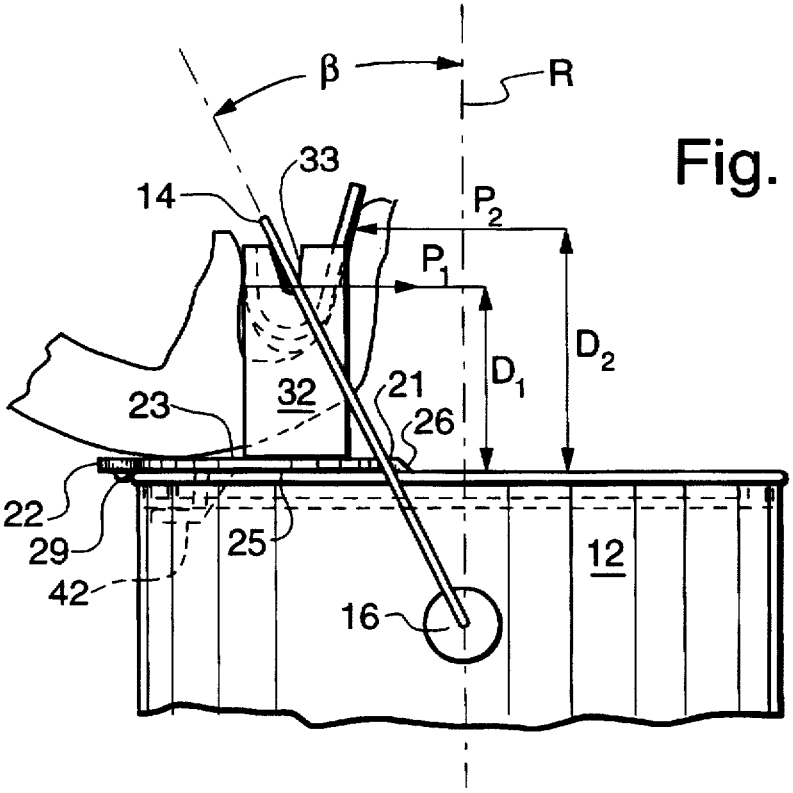
FIG. 4 is a schematic elevation representation of the holder of the present invention mounted on a paint can showing the applied torque forces when the can is held upright by the painter.

Not all receptacles 12 and bails 14 have the same dimensions. Thus, the particular dimensions of the height of the supports 32, 34, their positioning on the plate surface 23, and the distance to which the bail engaging slots 33, 35 extend above the top surface 23, are dependent upon the dimensions of the receptacle 12 and its bail 14. In a preferred embodiment wherein the receptacle is a typical 1 gallon paint can, the following dimensions apply: the height of supports 32, 34 is 2.19 inches and the distance of the bottom of the slots 33 and 35 above the top surface 23 of base plate 20 is 1.78 inches. In order for these dimensions to accommodate a snug fit of the bail, the supports 32, 34 themselves must be appropriately placed on the top surface 23 of base plate 20. For this particular embodiment, the supports are each positioned a distance of 13/16 inches back from front edge 21 and are evenly spaced from the outer perimeter 25. The supports are located a distance of approximately 4.26 inches apart from each other. Such a disposition of the supports 32, 34 causes the bail to sit at an offset angle $\beta$ as shown in FIG. 4. Angle $\beta$, in this embodiment, ranges from 22° to 26° from reference plane "R".

Grip 38 extends between supports 32 and 34 and is the part of the handle 10 which is actually grasped by the painter's hand. As shown in FIG. 1, it has three parts: a pressure applying front section 60, a back section 61 and a bottom section 63. The pressure applying section 60 extends at an angle between 0° and 90°0 measured clockwise from reference plane "R," and preferably at an angle which is about the same or greater than the angle of the bail. The bottom section 63 is preferably rounded having an outer convex curved surface. The bottom section at its closest point to the top surface of the handle base must still leave sufficient space for a painter to insert his hand, however, it must also be lower than the bottom of slots 33 and 35. Usually this minimum clearance between the base plate and the lowermost point of the grip 38 is one inch or more.

The back side 61 rises from the bottom section and must be sufficient to provide enough surface area for the back side of the painter's palm to lean against as the painter grasps the handle.

As illustrated, the handlebar resembles a trough. However the grip may also be solid in which case a channel may cut through a portion thereof to accommodate the bail.

One of the needs of a painter is for a place to temporarily rest the paint brush. In a preferred embodiment, a paint brush support is provided on the handlebar 30 of the device 10. The paint brush support generally comprises a cutout 62 in the front section 60 of the grip 38. Cutout 62 is sized to contain the handle of a paint brush. Typically paintbrushes have handles with continuously increasing widths as one moves away from the bristles. By placing the thinner portion of the handle within cutout 62 such that the bristles are pointed downward toward the interior of the receptacle 12, the brush comes to rest against the front edge 21 or the ledge 26 as the case may be and is retained on the handle in a position which allows any residual paint to drip in the paint can providing a convenient brush storage place.

Figure 5:
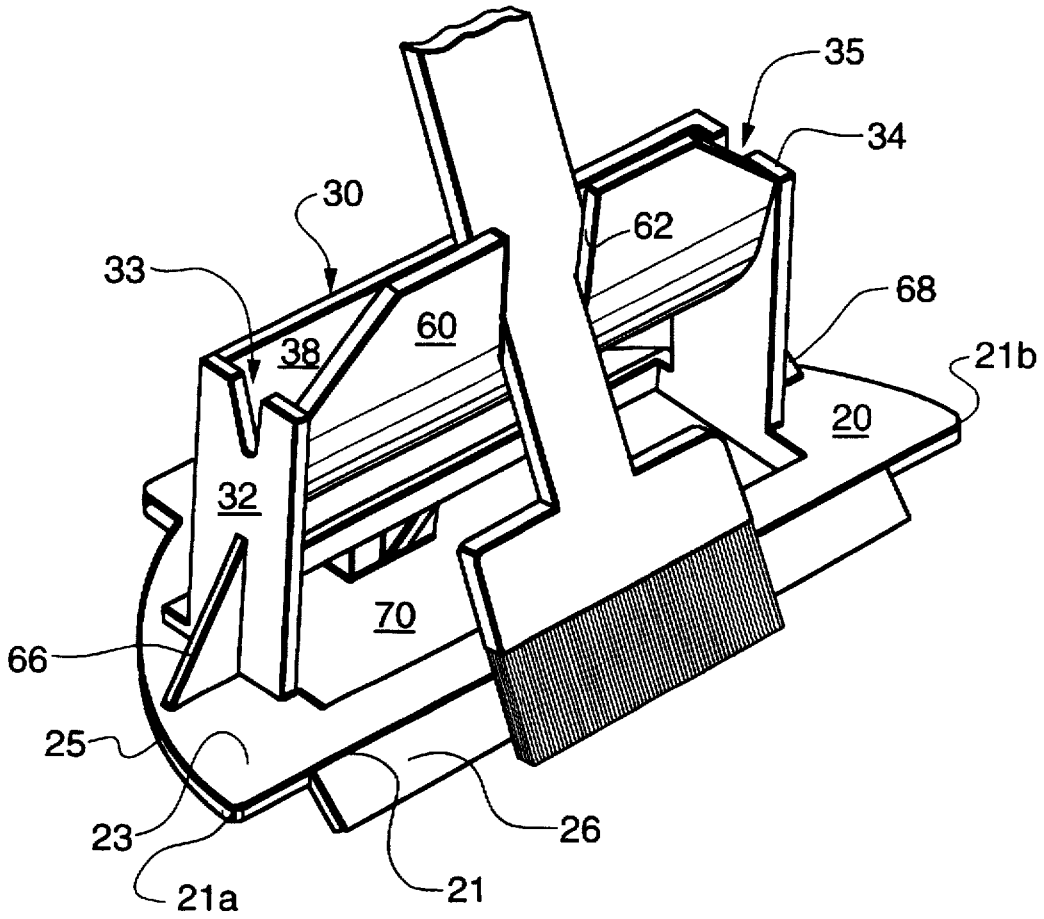
FIG. 5 is a perspective representation of a holder in accordance with the present invention showing a paint brush resting thereon.

An alternate preferred embodiment of the handle according to the present invention is shown in FIG. 5 wherein side triangular braces 66, 68 are attached to the supports 32, 34 and the base plate 20 to provide additional stability to the supports 32, 34 and the entire handle bar 30 itself. A portion of the base may also be removed from base plate 20 below the handlebar 30 and between supports 32, 34 to form an opening 70 in the base plate 20 to reduce the weight and manufacturing costs of the device 10.

In operation, the handle 10 is placed onto the receptacle 12. The bail 14 of the receptacle is moved from its upright position and into the bail engaging slots 33, 35. As the bail is moved into slots 33, 35, the entire handle 10 itself is moved along the plane of the open top in such a way that the rim engaging tab 40 and the knob 29 clamp onto the rim 13 of the receptacle 12. As the rim engaging tab 40 and knob 29 engage the rim 13, the bail 14 slides snugly into its respective bail engaging slots 33, 35. The device 10 is in position when the bail 14 is snugly contained within slots 33, 35 and rim engaging tab 40 and knob 29 have firmly clasped around the rim 13.

The painter now lifts the device by inserting his hand between the grip 38 and the base plate 20 grasping the grip 38 as shown in FIG. 4. Because the lifting point is not directly above the center of gravity of the receptacle, but is offset, as the can is lifted, the weight of the can exerts a force in the direction of arrow P1 which tends to tilt the can. The painter must compensate against this force by applying a force in the direction of arrow P2. The rotation point of the can is in the vicinity of the grip bottom which nests in the painter's palm. The two forces P1 and P2 which must balance each other for the can to remain upright provide two opposing torque forces T1 and T2 whose magnitude is P1×D1 and P2×D2. By making D2 bigger than D1, the necessary P2 to counterbalance the torque due to the weight of the receptacle is reduced. As a result, the painter needs to exert less force to hold the can upright, and the handle provides a more comfortable grip.

Once the handle is attached, one can place a paint brush into the slot 62 of the pressure applying front section 60 such that the bristles of the brush are resting against the ledge 26 while the handle of the brush is contained within the slot 62. During the painting process, the user can dip the bristles of the paint brush into the paint and can then evenly wipe off excess paint by wiping the bristles against ledge 26.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A detachable handle for a receptacle having an interior, an open top having an area, a lateral wall, a rim extending inwardly from the lateral wall, and a bail swingably mounted on diametrically opposed points on said wall, the handle comprising:

a base plate having a front edge, a back side opposite said front edge, a top surface, and a bottom surface;

a rim engaging tab extending from the bottom surface of the base plate adjacent the back side adapted to engage the rim between said tab and said bottom side; and a handle bar mounted on said base plate, the handle bar comprising a grip having a pressure applying front section, a back section and a bottom section, wherein:

I) the front pressure applying section terminates at a top edge and extends at an angle between 0° and 90° measured clockwise from a reference plane perpendicular to the base;

ii) the bottom section has an outer convex curved surface extending to a point which is more than one inch away from the top surface of the base; and iii) at least one bail engaging slot for receiving and maintaining the bail at an angle of between 20° and 60° from said reference plane when said base is mounted on said receptacle, the bail engaging slot having a bottom being at a distance measured from the base top surface which is less than a distance measured from the base top surface to the top edge of the front pressure applying section.

2. The detachable handle of claim 1 wherein the handle bar further comprises a first support and a second support, each of said supports being adapted to hold the grip.

3. The detachable handle of claim 2 wherein the grip is disposed between the first and second supports.

4. The detachable handle of claim 2 wherein said at least one bail engaging slot further comprising a first and a second bail engaging slot, said first bail engaging slot being formed on the first support, and the second bail engaging slot being formed on the second support.

5. The detachable handle of claim 2 further comprising a first triangular brace attached to the first support and a second triangular brace attached to the second support for providing additional stability to the supports.

6. The detachable handle of claim 1 wherein the front pressure applying section of the grip further comprises a cutout sized to contain a paint brush handle.

7. The detachable handle of claim 1 further comprising a ledge disposed along the front edge of the base plate, said ledge extending towards the interior of the receptacle at an angle of 0°–90° from the plane of said base plate.

8. The detachable handle of claim 7 wherein the angle at which the ledge extends is 45°.

9. The detachable handle of claim 1 wherein the base plate has an area which is less than 50% of the area of the open top of the receptacle.

10. The detachable handle of claim 1 wherein the grip is trough shaped.

* * * * *